US005680000A

United States Patent [19]

Zuk et al.

[11] Patent Number: 5,680,000

[45] Date of Patent: Oct. 21, 1997

[54] REFLECTIVE METAL HEAT SHIELD FOR METAL HALIDE LAMPS

[75] Inventors: Karlene J. Zuk, Hathorne, Mass.; Deborah J. Smith, Lake Grove, N.Y.; Joseph S. Kulik, Allenstown, N.H.

[73] Assignee: Osram Sylvania Inc., Danvers, Mass.

[21] Appl. No.: 553,163

[22] Filed: Nov. 7, 1995

[51] Int. Cl.[6] ..... H01J 61/30

[52] U.S. Cl. ..... 313/25; 313/27; 313/634

[58] Field of Search ..... 313/27, 44, 47, 313/626, 25, 26, 113, 634, 635

[56] References Cited

U.S. PATENT DOCUMENTS

| | | | |
|---|---|---|---|
| 2,152,989 | 4/1939 | Ewest et al. | 313/25 |
| 2,267,090 | 12/1941 | Freeman | 176/126 |
| 3,723,784 | 3/1973 | Sules et al. | 313/47 |
| 4,074,163 | 2/1978 | Van der Leeuw | 313/27 |
| 4,418,300 | 11/1983 | Otani et al. | 313/634 |
| 4,423,353 | 12/1983 | Ogata et al. | 313/634 |
| 4,581,557 | 4/1986 | Johnson | 313/25 |
| 4,651,048 | 3/1987 | Liebe | 313/44 |
| 4,948,530 | 8/1990 | Barthelmes et al. | 252/520 |
| 5,162,693 | 11/1992 | Van der Leeuw et al. | 313/27 |
| 5,336,968 | 8/1994 | Strok et al. | 313/25 |

FOREIGN PATENT DOCUMENTS

| | | | |
|---|---|---|---|
| 0366187 | 5/1990 | European Pat. Off. | H01J 61/35 |

*Primary Examiner*—Michael Horabik
*Assistant Examiner*—Michael Day
*Attorney, Agent, or Firm*—William H. McNeill

[57] ABSTRACT

An arc robe for a discharge lamp comprises a hollow body containing an arc generating and sustaining medium. The body has oppositely disposed ends each containing an electrode sealed therein by a seal associated with the ends. At least one of the ends has a heat shield thereabout, the heat shield comprising a metal foil wrapped about the end and being fixed to the seal. The metal foil is preferably nickel having a thickness of from about 0.0254 mm to 0.127 mm.

5 Claims, 1 Drawing Sheet

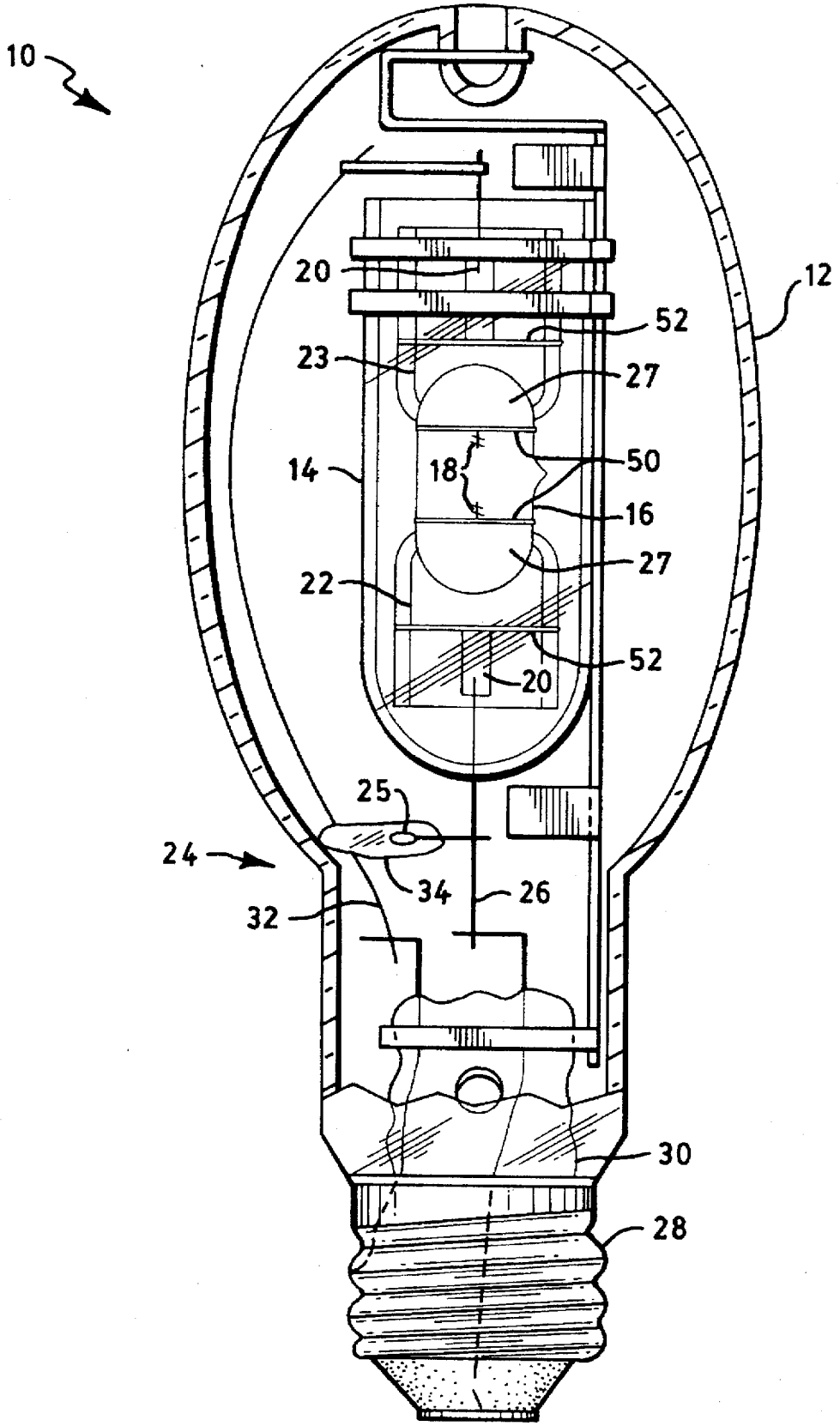
10
12
20
52
23
27
14
18
50
16
27
22
52
20
25
24
34
26
32
30
28

REFLECTIVE METAL HEAT SHIELD FOR METAL HALIDE LAMPS

TECHNICAL FIELD

This invention relates to arc tubes for discharge lamps and more particularly to a heat shield for such arc tubes.

BACKGROUND ART

The application of reflective heat shields on or near the ends of arc discharge tubes, particularly of the metal halide variety, to thermally insulate the cold spot areas and allow more favorable light-emitting species of condensate to vaporize and enter the plasma arc, are known.

Thermal control of the arc tube in a metal halide high intensity discharge (HID) lamp is important because the temperature of the coldest area or areas controls the vapor pressure and thus the concentrations of light-emitting species in the plasma.

The prior art has suggested achieving such thermal control in a number of ways. For example, U.S. Pat. No. 4,948,530 to Barthelemes et al. employs a metal oxide coating such as zirconia; European Patent No. 89202632.9 to Van der Leeuw et al. suggest a metallically reflecting graphite film; and U.S. Pat. No. 2,267,090 to Freeman utilizes cup-shaped metal shields attached to bridges adjacent the supported ends of the lamp.

Problems frequently occurring with these prior art techniques included darkening of the coatings, poor adhesion, cracking peeling and flaking. Additionally, these techniques required well-specified application processes and control measures. The cup-shaped metal shields were expensive to manufacture and mount and occasionally lead to electrolysis of the light supplying media contained within the arc tube.

DISCLOSURE OF INVENTION

It is, therefore, an object of the invention to obviate the disadvantages of the prior art.

It is another object of the invention to enhance the operation of HID lamps.

These objects are accomplished, in one aspect of the invention, by the provision of an arc tube for a discharge lamp which comprises a hollow body containing an arc generating and sustaining medium. The body has oppositely disposed ends each containing an electrode sealed therein by a seal associated with the ends. At least one of the ends has a heat shield thereabout, this heat shield being comprised of a metal foil wrapped about the end and being fixed to the seal.

This construction eliminates the peeling, cracking and flaking of the metal oxide and graphite coatings and is less expensive than pre-formed cup-shaped metal shields. It is less expensive to apply to the arc tube. And, no organic residuals are present which could compromise evacuation or the inert gas fill that may be employed in the outer bulb. Further, by ensuring that the foil shields are electrically isolated from other metal components within the lamp, electrolysis is reduced, thereby not compromising lamp life.

BRIEF DESCRIPTION OF THE DRAWINGS

The single FIGURE is an elevational view, partly in section, of a lamp employing an embodiment of the invention.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Referring now to the drawings with greater particularity there is shown in the FIGURE a metal halide arc discharge lamp 10 having a sealed envelope 12 which may be evacuated or filled with an inert gas, enclosing a quartz sleeve 14. The sleeve or shroud 14 surrounds an arc tube 16 having electrodes 18 located at opposite ends thereof and containing a fill material capable of generating and sustaining an arc. The fill can comprise mercury, metal halides and argon, as is well known. In a preferred embodiment at least the halides of sodium, lithium and scandium are present. Each electrode is coupled to a moly ribbon 20 which is enclosed in a press seal 22, 23, that hermetically seals the ends of the arc tube. Electrical energy is coupled from a lamp base 28 through a lamp stem 30 and leads 32 and 26 to the electrodes 18 of the arc tube. A metal foil heat shield 27, covers at least one of the ends of the arc tube to control the cold spot temperature.

A UV enhancer 24 has a sealed envelope 34 that encloses an electrode 25. The electrode 25 is coupled to the lead-in wire 26 and is capacitively coupled to the lead-in wire 32, which may include a conductor that is helically wrapped around the envelope 34. A typical UV enhancer is about 4.0 mm in diameter and 15.0 to 20.0 mm in overall length. Further details of UV enhancers are disclosed in U.S. Pat. No. 5,323,091.

The shroud 14 shown in the FIGURE has a domed configuration; however, it is to be understood that a shroud comprising a cylinder open at both ends is equally appropriate, such shrouds also being known.

The metal foil (or foils) 27 can be any metal that can be sufficiently out-gassed so as not to cause problems in the environment that exists in the outer envelope, but is preferably nickel having a thickness of about between 0.0254 mm and 0.127 mm. Foil 27 should have an upper edge 50 and a lower edge 52 such that the longitudinal extent of the foil 27 is sufficient to achieve the desired cold spot temperature without absorbing too much light output to reduce the lumens and color temperature. Generally, the upper edge should not quite cover the electrode and the lower edge should extend about half the distance of the seal. The actual length of the foil will depend upon the length of the arc tube, which, of course, varies with the wattage of the lamp with which it is employed.

In an example, two filled metal halide arc tubes (400 W) were wrapped with nickel foil, 0.127 mm thick in the cold spot areas; i.e., at the ends of the tubular part of the arc tube and surrounding the electrodes, as shown in the FIGURE. As a control, six other arc tubes from the same lot were dip-coated with $ZrO_2$ paint about 15 μm thick. The arc tubes were fabricated into lamps using standard productions procedures. After a 100 hour age, with the lamps cycling 10 hours on and 2 hours off, the nickel shielded lamps showed an average 21% higher lumens versus the oxide coated lamps. The spectral radiation from the nickel shielded lamps is different from that of the control lamps emission spectra. The metal shielded lamps have higher sodium, scandium and lithium emissions, and lower mercury emissions than the oxide-coated lamps resulting in a lower color temperature. In the metal foil shielded lamps, the condensate in the extinguished lamps was deposited more toward the center of the arc tube, indicating that more radiative species are incorporated into the arc when the lamps are operating, i.e., the lamps have a higher cold spot temperature, which enhances lumen output and governs color temperature.

In a second example, nine 100 W, filled metal halide arc tubes were chosen from a common lot. Five had nickel foil metal shields of 0.0254 mm thickness applied. Four were dip-coated with standard zirconia end paint. The tubes were fabricated into lamps using standard production procedures. At zero hours, the nickel-foiled lamps had 8.7% lower lumens, 3.7% lower color temperature and 2.1% higher color rendering index (CRI). After 100 hours of operation with the lamps being cycled 10 hours on, two hours off, the test group still had lower lumens (11.4%) lower color temperature (7.6%) and higher CRI (2.1%). The lower lumens in the metal shielded lamps is assumed to be due to the physical blocking of light because a higher percentage of the arc tubes was covered than in the lamps of Example 1. In spite of the slightly lower lumens, the lamps exhibited the favorable qualities of less variation in, and better control of the rise of color temperature. Of course, the foil also eliminated the flaking and discoloration of the prior art techniques.

While there have been shown and described what are at present considered the preferred embodiments of the invention, it will be apparent to those skilled in the art that various changes and modifications can be made herein without departing from the scope of the invention as defined by the appended claims.

What is claimed is:

1. An arc tube for a discharge lamp comprising: a hollow body containing an arc generating and sustaining medium, said body having oppositely disposed ends each containing an electrode sealed therein by a seal of a given length associated with said ends; at least one of said ends having a heat shield thereabout, said heat shield comprising a metal foil wrapped about said end and being fixed to said seal, said metal foil having a length extending along said seal less than said given length and being in intimate contact with said seal and being electrically and mechanically isolated from any electric current carrying member.

2. The arc tube of claim 1 wherein said metal foil is nickel.

3. The arc tube of claim 2 wherein said metal foil has a thickness of from about 0.0254 mm to 0.127 mm.

4. The arc tube of claim 2 wherein each of said oppositely disposed ends has a metal foil thereabout.

5. A metal halide arc discharge lamp comprising: an arc tube containing an arc generating and sustaining medium and having first and second electrodes sealed at opposite ends thereof by a seal having a given length associated with said ends; an outer envelope surrounding said arc tube and having first and second terminals for electrical connection thereto; an electrical connector coupling said first electrode to said first terminal; an electrical connector coupling said second electrode to said second terminal; and a metal foil heat shield on at least one end of said arc tube, said metal foil heat shield having a length extending along said seal less than said given length and being in intimate contact with said seal and being isolated from any of said electrical connectors whereby electrolysis is substantially prevented.

* * * * *